US009248333B2

(12) United States Patent
Staten et al.

(10) Patent No.: US 9,248,333 B2
(45) Date of Patent: Feb. 2, 2016

(54) ADJUSTABLE SUPPORT FOR EXERCISE SYSTEM

(71) Applicant: Rogers Athletic Company, Clare, MI (US)

(72) Inventors: Kenneth Staten, Clare, MI (US); Kyle R. Camp, Clare, MI (US)

(73) Assignee: Rogers Athletic Company, Clare, MI (US)

( * ) Notice: Subject to any disclaimer, the term of this patent is extended or adjusted under 35 U.S.C. 154(b) by 246 days.

(21) Appl. No.: 13/874,629

(22) Filed: May 1, 2013

(65) Prior Publication Data

US 2013/0296143 A1 Nov. 7, 2013

Related U.S. Application Data

(60) Provisional application No. 61/640,899, filed on May 1, 2012.

(51) Int. Cl.

| | |
|---|---|
| ***A63B 21/062*** | (2006.01) |
| ***A63B 21/06*** | (2006.01) |
| ***A63B 23/035*** | (2006.01) |
| ***A63B 21/078*** | (2006.01) |
| ***A63B 21/16*** | (2006.01) |
| *A63B 21/072* | (2006.01) |
| *A63B 23/12* | (2006.01) |

(52) U.S. Cl.

CPC ..... *A63B 21/0618* (2013.01); *A63B 21/078* (2013.01); *A63B 21/16* (2013.01); *A63B 23/03558* (2013.01); *A63B 21/0724* (2013.01); *A63B 23/1218* (2013.01); *A63B 2225/093* (2013.01)

(58) Field of Classification Search

CPC ..... A63B 21/062; A63B 21/0615; A63B 21/0724; A63B 21/078; A63B 21/08; A63B 21/0626; A63B 21/0612; A63B 21/0616; A63B 21/0617; A63B 21/0783

USPC ..... 482/98, 92, 100, 97

See application file for complete search history.

(56) References Cited

U.S. PATENT DOCUMENTS

| | | | | |
|---|---|---|---|---|
| 5,116,297 | A * | 5/1992 | Stonecipher | 482/97 |
| 6,770,017 | B1 * | 8/2004 | Leipheimer | 482/142 |
| 7,753,830 | B1 * | 7/2010 | Marsh et al. | 482/142 |
| 2006/0100075 | A1 | 5/2006 | Harsh | |
| 2012/0244999 | A1 | 9/2012 | Tauriainen | |

* cited by examiner

*Primary Examiner* — Loan H Thanh
*Assistant Examiner* — Megan Anderson
(74) *Attorney, Agent, or Firm* — Carlson, Gaskey & Olds, P.C.

(57) ABSTRACT

An exercise device including at least one attachment structure configured to be mounted to a support assembly. A first arm and a second arm pivotably connected to the at least one attachment structure. At least one bracket pivotably connecting an end of the first arm with an end of the second arm. At least one of catch member pivotably connected to at least one of the first arm, the second arm, and the at least one bracket. The at least one catch member is configured for accepting a weight bar.

23 Claims, 14 Drawing Sheets

ADJUSTABLE SUPPORT FOR EXERCISE SYSTEM

CROSS-REFERENCE TO RELATED APPLICATIONS

The application claims priority to U.S. Provisional Application No. 61/640,899 which was filed on May 1, 2012.

BACKGROUND

The present disclosure relates to weightlifting equipment and, more particularly, to an adjustable support for resting a weight bar.

Weightlifters perform various exercises for the purpose of developing particular muscles throughout the body. These exercises can be performed through the use of free weights, such as barbells, or with machines. Many weightlifters prefer free weights because free weights permit the lifter to perform the exercises in a natural motion while utilizing pure body leverage in performing the exercise. This facilitates isolation of particular muscle groups and simulates actual athletic sports motions. The support assembly also often operates to spot the lifter.

SUMMARY

An exercise device including at least one attachment structure configured to be mounted to a support assembly. A first arm and a second arm pivotably connected to the at least one attachment structure. At least one bracket pivotably connecting an end of the first arm with an end of the second arm. At least one of catch member pivotably connected to at least one of the first arm, the second arm, and the at least one bracket. The at least one catch member is configured for accepting a weight bar.

An exercise assembly including a support frame and an exercise device attached to the support frame. The exercise device including at least one attachment structure configured to be mounted to a support assembly. A first arm and a second arm pivotably connected to the at least one attachment structure. At least one bracket pivotably connecting an end of the first arm with an end of the second arm. At least one of catch member pivotably connected to at least one of the first arm, the second arm, and the at least one bracket. The at least one catch member is configured for accepting a weight bar.

A method of adjusting a height of an exercise device including selecting a first course height of the exercise device along an attachment structure and selecting a second fine height of the exercise device by engaging an extension member.

These and other features of the disclosed examples can be understood from the following description and the accompanying drawings, which can be briefly described as follows.

DETAILED DESCRIPTION

Figure 1:
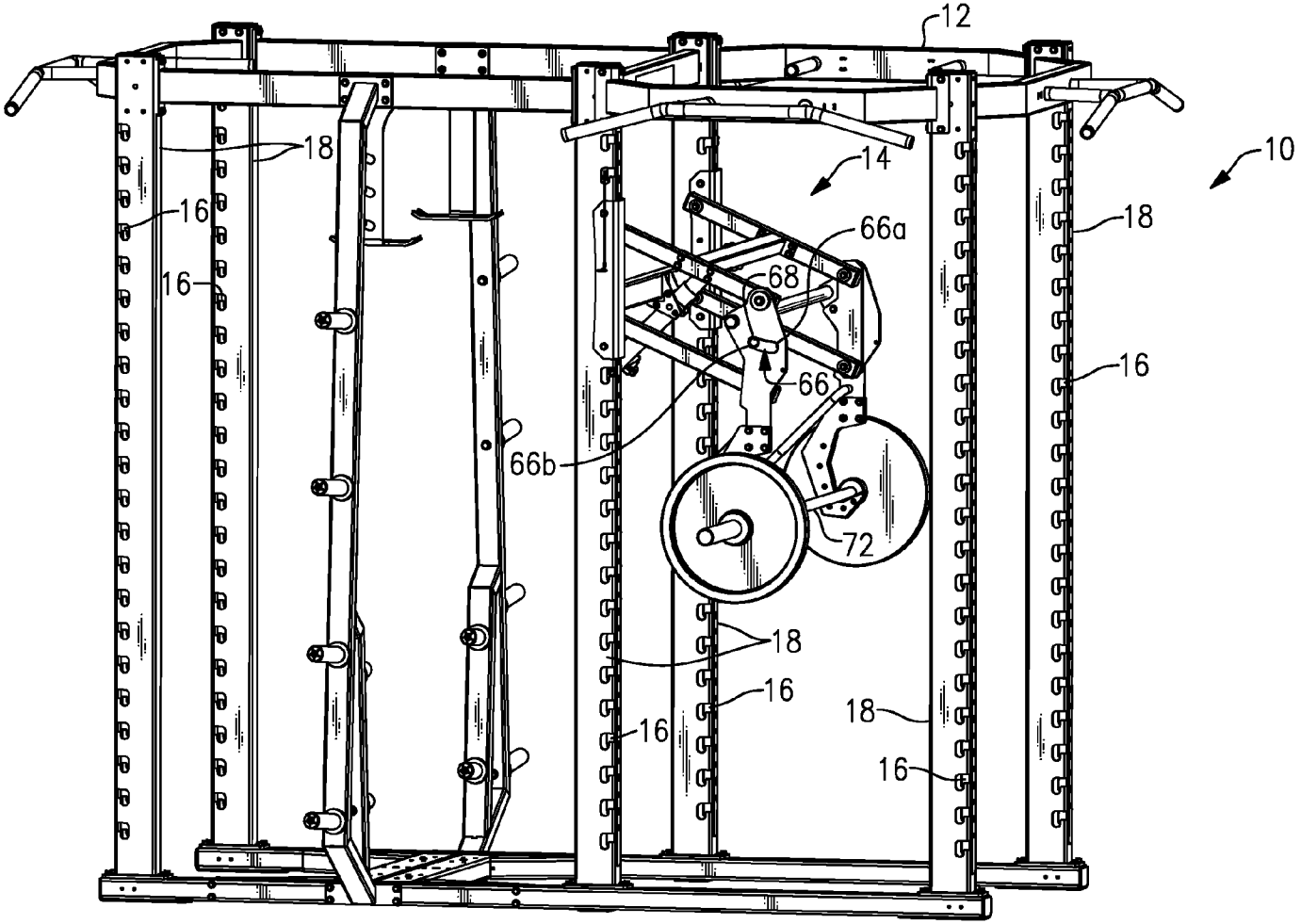
FIG. 1 is a general perspective view of an example exercise system according to an example embodiment.

FIG. 1 illustrates an example exercise system 10 including an example frame rack 12 and an example adjustable support 14. The frame rack 12 holds the adjustable support 14. It should be understood that although a particular frame rack 12 is illustrated in the example embodiment, other types of frame racks 12 could be used to hold the adjustable support 14. The adjustable support 14 is considered a monolift assembly in some examples.

Figure 14:
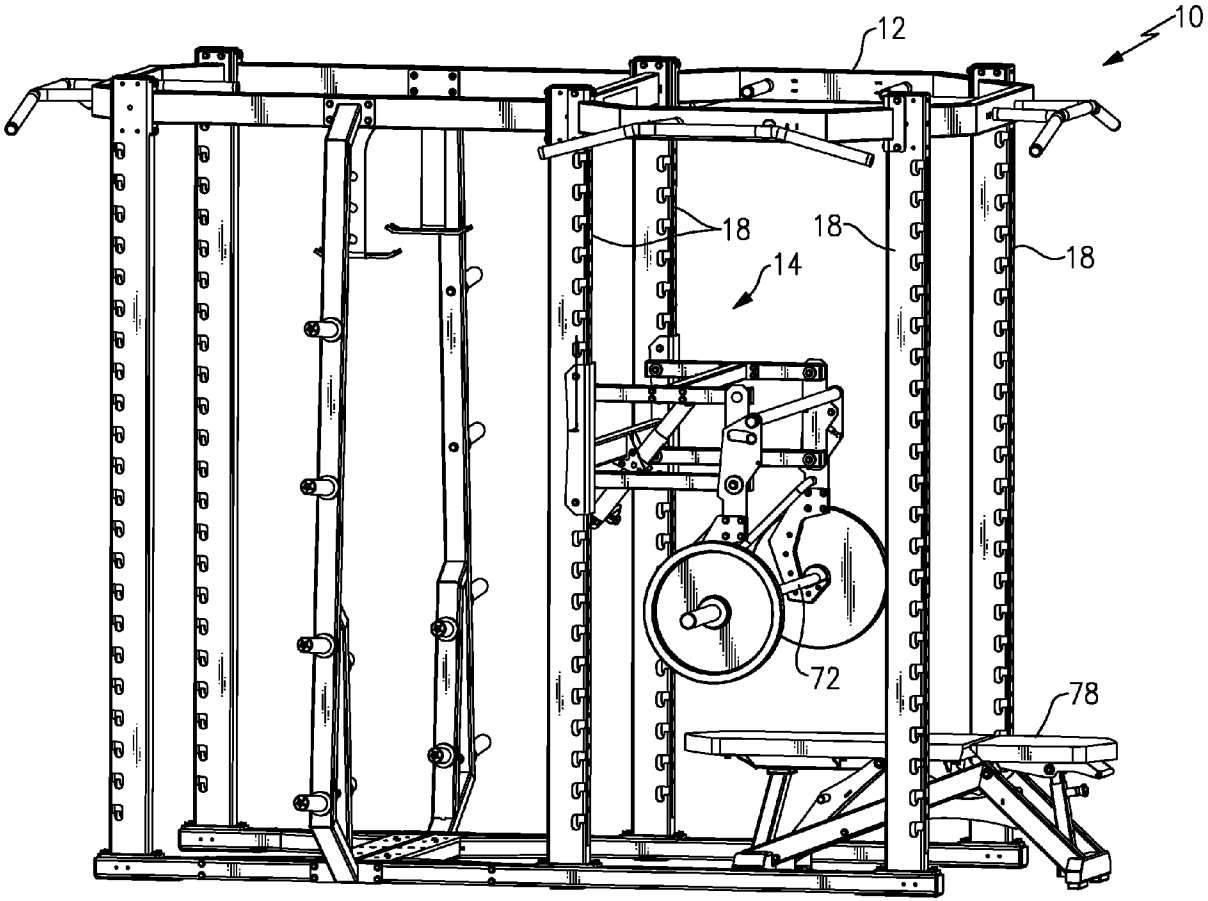
FIG. 14 is a general perspective view of the adjustable support of FIG. 8 in a bench press position.

The frame rack 12 includes multiple openings 16 that extend along upright frame members 18 to receive the adjustable support 14. The adjustable support 14 is received in selected openings so that the adjustable support 14 may be located at various vertical positions along the upright frame members 18. By allowing for multiple vertical positions, a user can utilize the adjustable support 14 for performing squats or bench presses with a bench 78 (FIG. 14) or other types of exercises. Each opening 16 is vertically separated from the next opening 16 by approximately four inches to provide significant incremental adjustment, however, any separation will be usable with the present invention.

Figure 2:
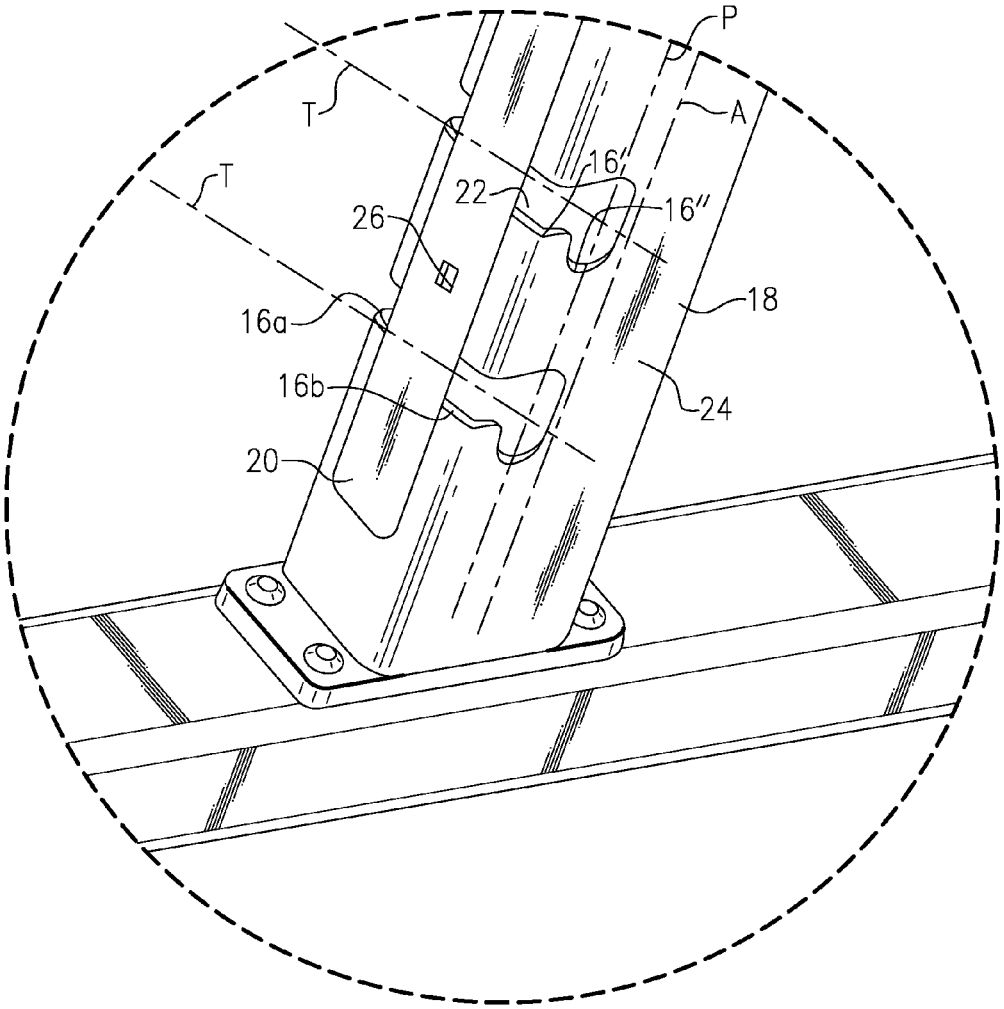
FIG. 2 is an expanded view of a weight lifting system upright frame member.

Referring to FIG. 2, each upright frame member 18 defines a longitudinal axis A extending vertically relative to the ground. The example upright frame member 18 is generally rectilinear in shape and is manufactured of tubing that is rectangular in cross-section. The upright frame member 18 has a front face 20, a first side face 22, and second side face 24. The upright frame member 18 includes multiple opposed pairs of openings 16*a*, 16*b* along the longitudinal axis A. Each of the opposed pairs of openings 16*a*, 16*b* includes a first opening 16*a* and a second opening 16*b*.

Each opening 16 is generally L-shaped and spans the intersection of the front face 20 and one of the side faces 22 and 24. In this non-limiting embodiment, the first opening 16*a* spans the front face 20 and the side face 22 and the second opening 16*b* spans the front face 20 and the side face 24. In other words, each opening 16*a*, 16*a* cuts through the corner of the upright frame member 18.

Figure 3:
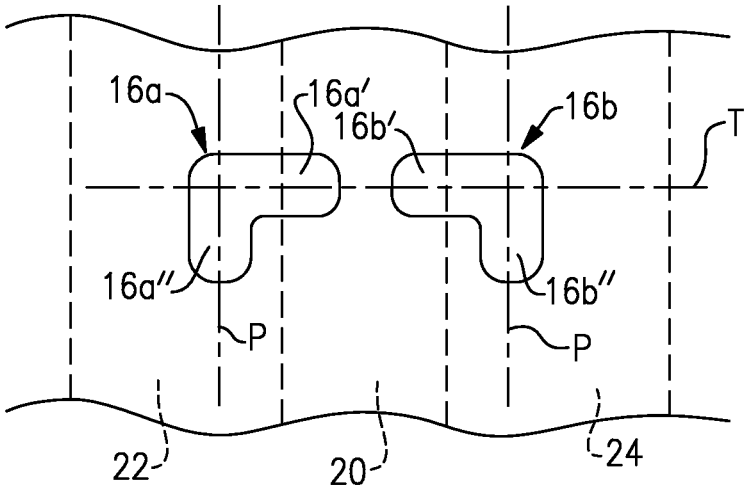
FIG. 3 is a schematic view of an opening in a weight lifting system upright frame member illustrated in FIG. 2.

Each opening 16 includes a first opening portion 16' in the front face 20 generally transverse to the longitudinal axis A along a transverse opening axis T and a second opening portion 16" through the respective side face 22 and 24 generally parallel to the longitudinal axis A along a parallel opening axis P. In this non-limiting embodiment, the first opening 16*a* defines a first opening portion 16*a*' through the front face 20 generally transverse to the longitudinal axis A along the transverse opening axis T and a second first opening portion 16*a*" through the first side face 22 generally parallel to the longitudinal axis A along the parallel axis P while the second opening 16*b* defines a first second opening portion 16*b*' through the front face 20 generally transverse to the longitudinal axis A along the transverse opening axis T and a second opening portion 16*b*" through the second side face 24 generally parallel to the longitudinal axis A along the parallel axis P. That is, the portions 16*a*', 16*b*' and 16*a*", 16*b*" are generally perpendicular and portions 16*a*' and 16*b*' are generally parallel if laid flat (FIG. 3). Preferably, each opening 16*a*, 16*b* includes relatively large corner radiuses.

The openings 16 are arranged in horizontally opposed pairs of openings 16*a*, 16*b* perpendicular to the longitudinal axis A. That is, each pair of openings 16 includes a first opening 16*a* located through the front face 20 and the first side face 22 and a second opening 16*b* located through the front face 20 and the second side face 24 such that the openings 16*a*, 16*b* are aligned when viewed from one of the side faces 22, 24.

A lock opening 26 is located through the front face 20 between each vertically separated pair of openings 16. Each lock opening 26 is displaced parallel to the longitudinal axis A and is generally square in shape. It should be understood that other shapes will also be readily usable with the example embodiment. The example lock opening 26 is longitudinally staggered above each pair of openings 16*a*, 16*b*.

Figure 4:
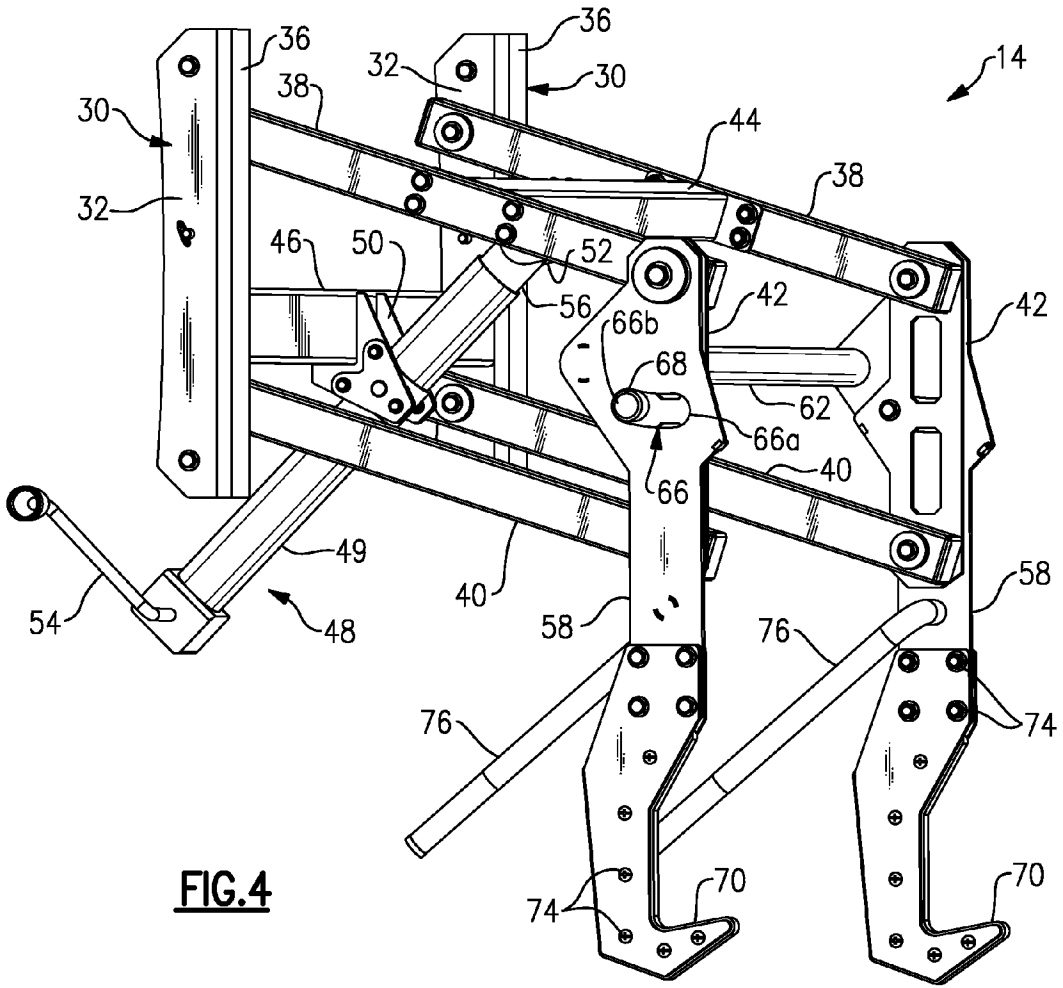
FIG. 4 is a side perspective view of an example adjustable support.
Figure 5:
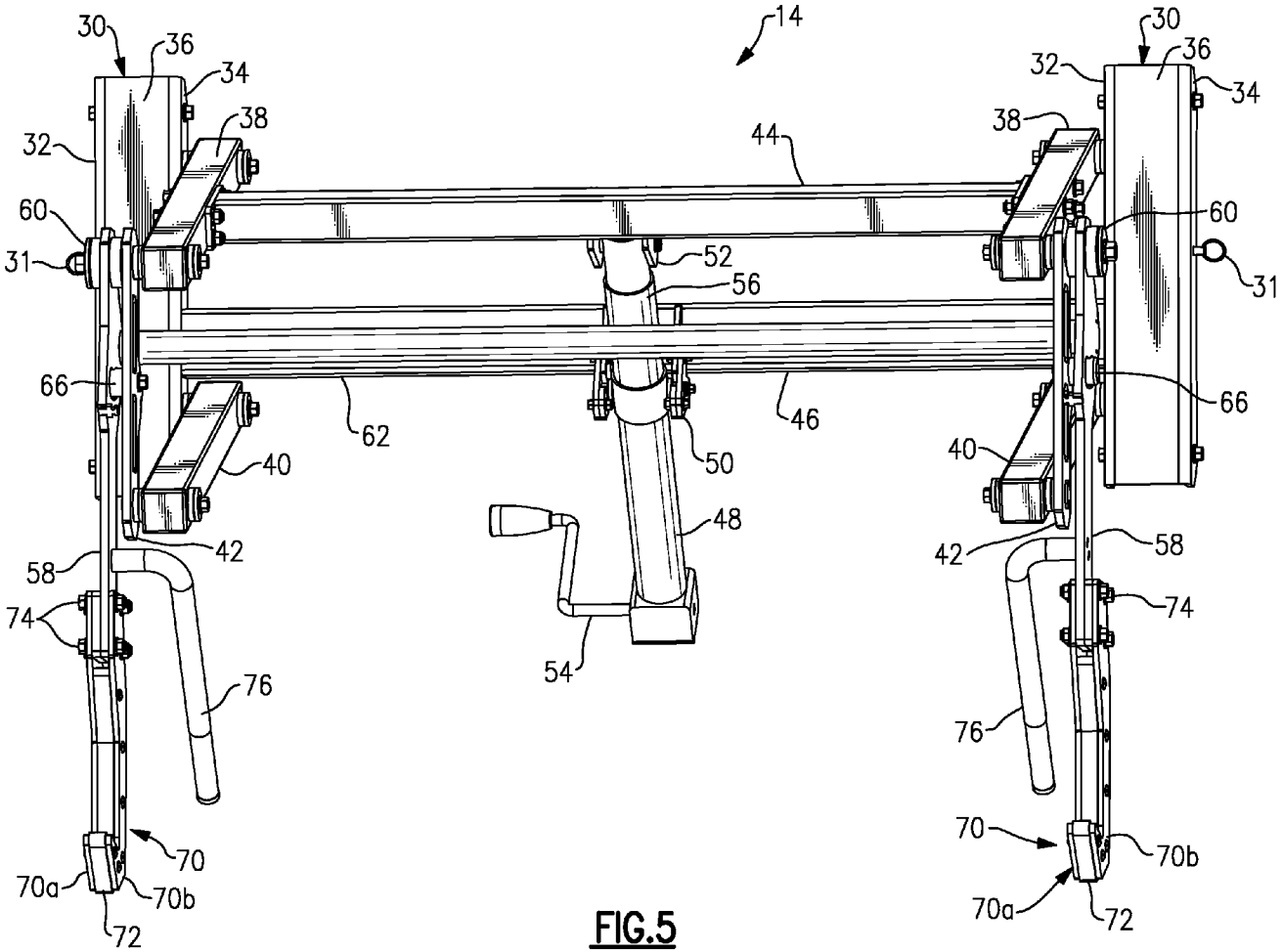
FIG. 5 is a front perspective view of the example adjustable support of FIG. 4.

Referring to FIGS. 4 and 5, the adjustable support 14 includes a pair of attachment structures 30 each having a first attachment plate 32 opposed to and generally parallel with a second attachment plate 34. The first and second attachment plates 32 and 34 extend generally perpendicularly from a central support plate 36. The first and second attachment plates 32 and 34 and the central support plate 36 have a general U-shaped cross section. The adjustable support 14 is vertically adjustable between multiple vertical heights along the upright frame members 18.

A pair of upper arms 38 and a pair of lower arms 40 extend from, and are pivotably attached to, the pair of attachment structures 30. A pair of brackets 42 extend between, and are pivotably attached to, the distal ends of the pair of upper arms 38 and the pair of lower arms 40. The pair of attachment structures 30, the pair of upper arms 38, the pair of lower arms 40, and the pair of brackets 42 form a pair of four-bar linkages. The pair of four-bar linkages are coupled together by an upper arm connecting member 44 attached to each of the upper arms 38 and a support arm connecting member 46 attached to each of the attachment structures 30. The four-bar linkages are parallelogram linkages, which allows the pair of attachment structures 30 to remain parallel with the pair of brackets 42 and the pair of upper arms 38 to remain parallel with the pair of lower arms 40 during movement of the upper arms 38, lower arms 40, and brackets 42.

A jack 48, such as a screw jack or a hydraulic jack, varies the position of the pair of upper arms 38, the pair of lower arms 40, and the pair of brackets 42 relative to the attachment structures 30, which are attachable to the upright frame members 18. The jack 48 includes a body portion 49, which is pivotably attached to the support arm connecting member 46 by a first pivot bracket 50, and a rod member 56 having a distal end pivotably attached to a second pivot bracket 52 on the upper arm connecting member 44. The jack 48 includes a rotatable handle 54 that extends the rod member 56 to raise the upper and lower arms 38 and 40 and the pair of brackets 42 when rotated in a first direction and retracts to lower the upper and lower arms 38 and 40 and the pair of brackets 42 when rotated in a second direction opposite the first direction. The jack 48 allows for relatively fine adjustment of the adjustable support 14 to multiple lift positions, such as a squat position.

A catch member 58 is pivotably attached at each of the pivot points between the pair of upper arms 38 and the pair of brackets 42. Each catch member 58 includes an elongated arcuate slot 66 spaced from the pivot axis. Each slot 66 accepts a stopper 68, such as a rubber bushing, that is rigidly attached to each of the pair of brackets 42 for limiting the range of motion of the catch members 58 relative to the pair of brackets 42. A catch member connecting arm 62 extends between and is rigidly connected to each of the catch members 58 so that the catch members 58 move together in unison. Since the attachment structures 30, the upper and lower arms 38, 40, and the pair of brackets 42 form a parallelogram four-bar linkage, the catch members 58 will maintain essentially the same alignment relative to the pair of brackets 42 when the adjustable support 14 is being adjusted by the jack 48.

The distal end of the catch members 58 includes a hook portion 70 for engaging a weight bar 72 (FIG. 1). The hook portion 70 includes a first half 70*a* and a second half 70*b* that sandwiches a grip member 71, such as a rubber or a plastic member, to increase the hook portion's 70 ability to grip the weight bar 72. A plurality of fasteners 74 secure the first half 70*a* to the second half 70*b* and secure the hook portion 70 to the remaining portion of the catch member 58.

A spring loaded member 60 is located adjacent the pivot axis of the catch members 58 for biasing the catch members 58 toward a retracted position where the stopper 68 engages a first end 66*a* of the slot 66. The biasing force of the spring loaded members 60 is overcome when the weight bar 72 is placed on the hook portions so that the catch members 58 move to a generally vertical position where the stopper 68 engages a second end 66*b* of the slot 66 (FIG. 1).

An elongated handle 76 is attached to each of the catch members 58 for facilitating movement of the catch members 58 toward a vertical position to accept the weight bar 72 when spotting a lifter. The handles 76 are located on both of the catch members 58 to allow a spotter to move the catch members 58 from either side of the lifter during lifting.

Figure 6:
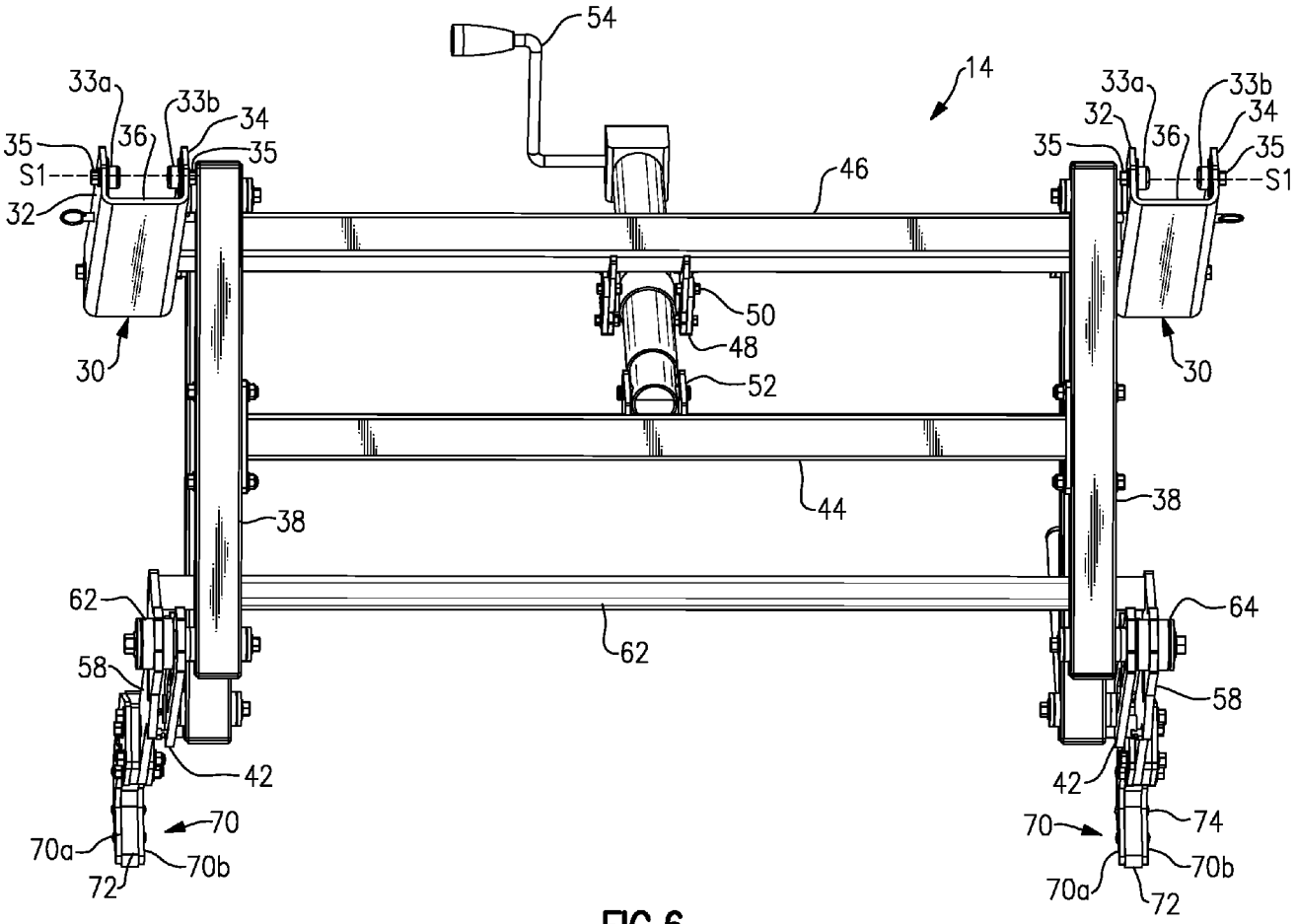
FIG. 6 is a top perspective view of the example adjustable support of FIG. 4.
Figure 7:
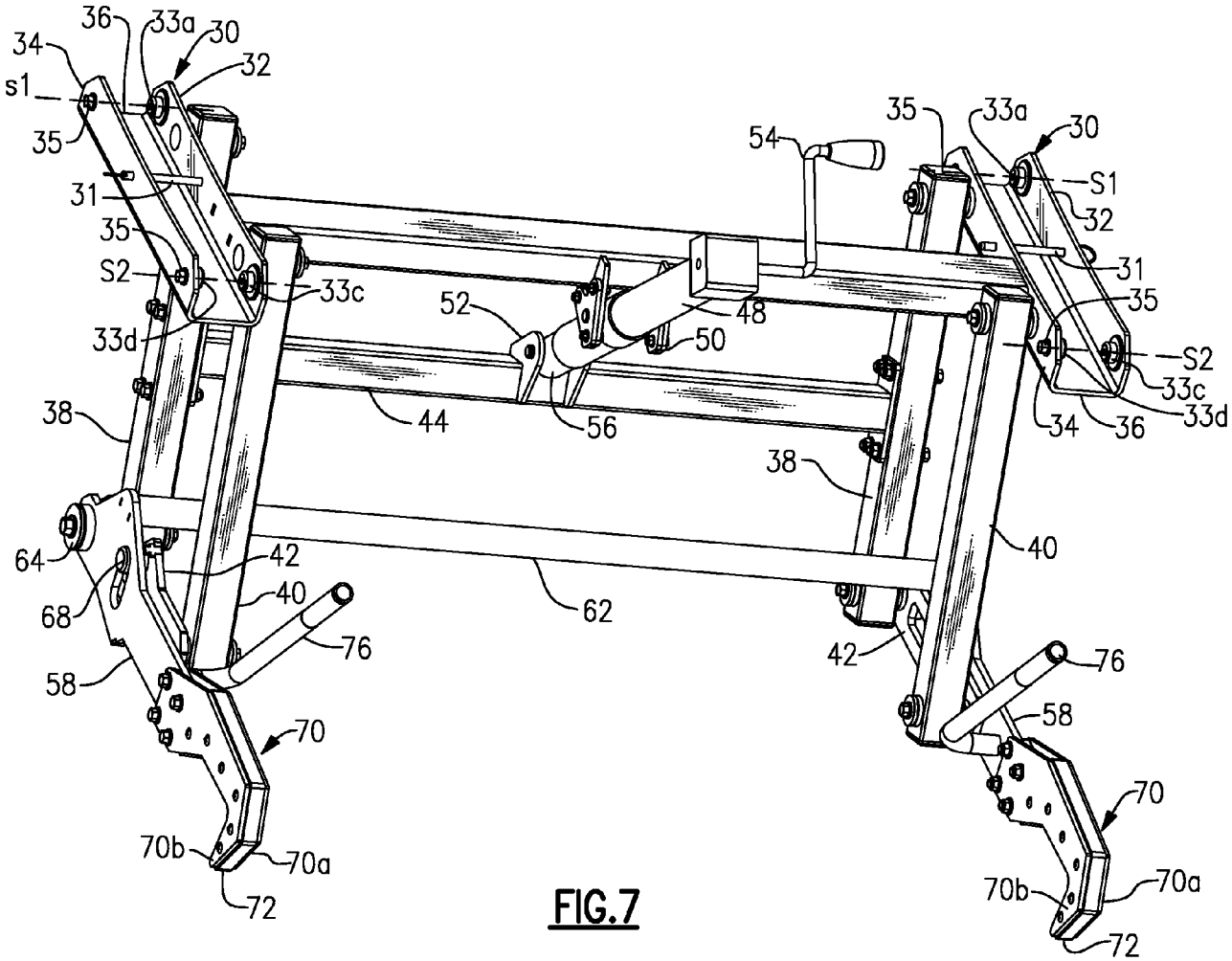
FIG. 7 is a bottom perspective view of the example adjustable support of FIG. 4.
Figure 8:
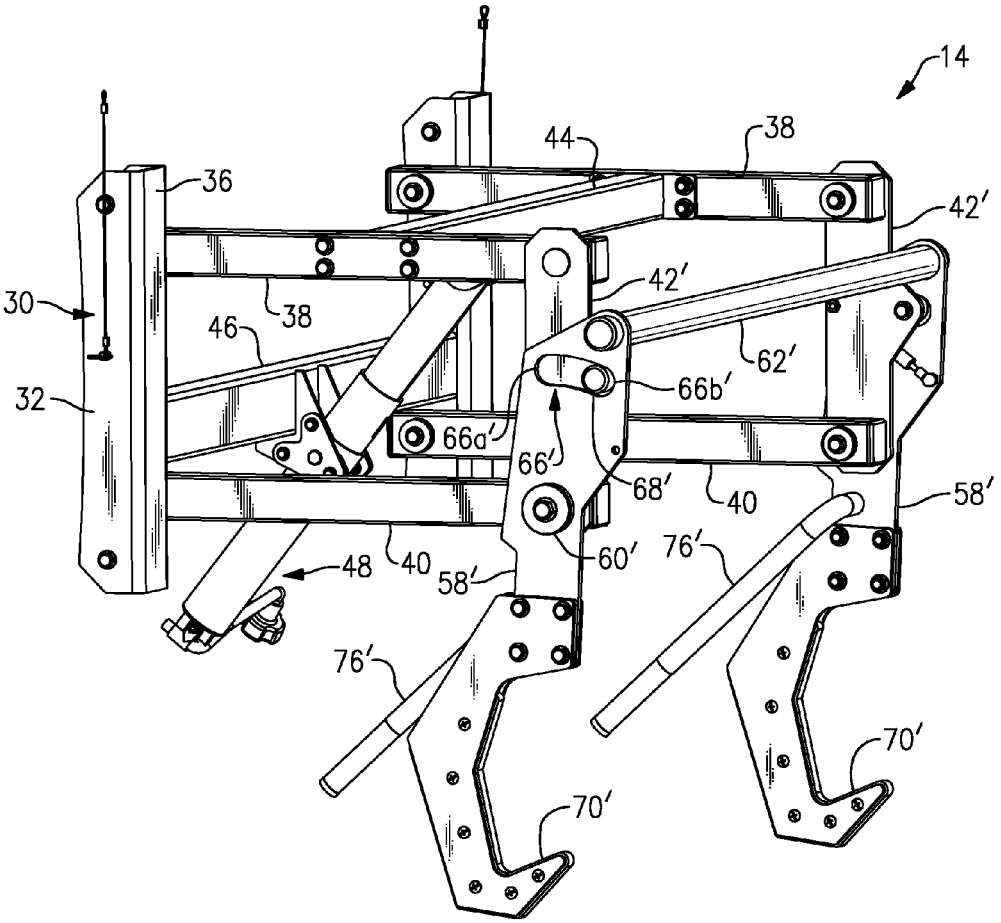
FIG. 8 is a general perspective view of the adjustable support of FIG. 4 with another example catch member and example pair of brackets.

Referring to FIGS. 6 and 7, a first, second, third, and fourth stud 33*a*-33*d* extend from an inner surface of the first and second attachment plates 32, 34 to engage the openings 16 (FIG. 2). The first stud 33*a* extends from the first attachment plate 32 and is directly opposed to the second stud 33*b* which extends from an inner surface of the second attachment plate 34. The third stud 33*c* extends from the first attachment plate 32 and is directly opposed to the fourth stud 33*d* which extends from an inner surface of the second attachment plate 34. The first and second studs 33*a*, 33*b* are located on a common axis S1 and the third and fourth studs 33*c*, 33*d* are located along a common axis S2. The studs 33*a*-33*d* are relatively significant solid members which mount through the first and second attachment plates 32, 34 with fasteners 35 or the like. A safety pin 31 extends through the first and second attachment plates 32, 34 to secure the adjustable support 14 to the upright frame members 18 by extending through the openings 16.

Figure 9:
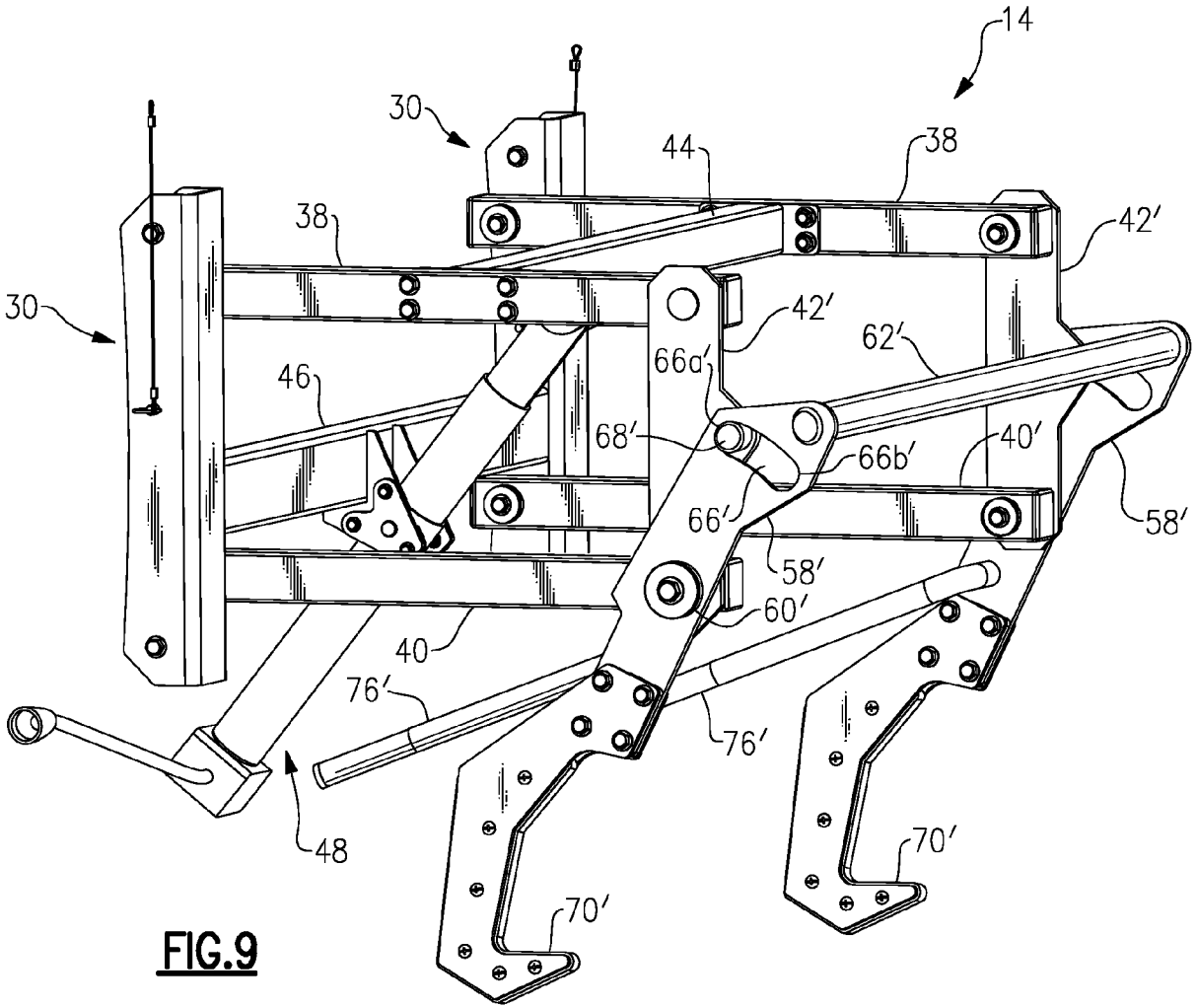
FIG. 9 is a general perspective view of the adjustable support of FIG. 8.
Figure 10:
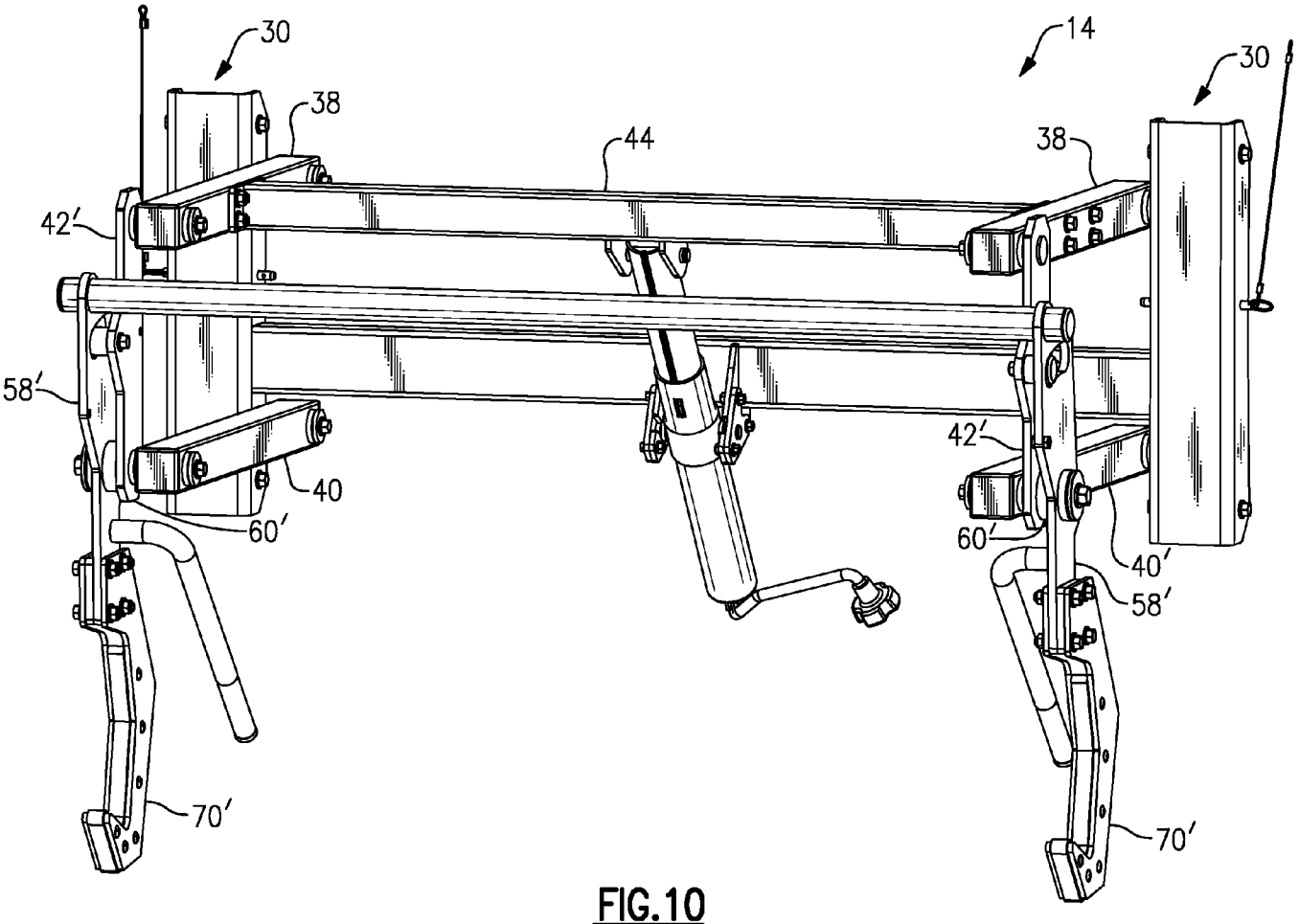
FIG. 10 is a general perspective view of the adjustable support of FIG. 8.
Figure 11:
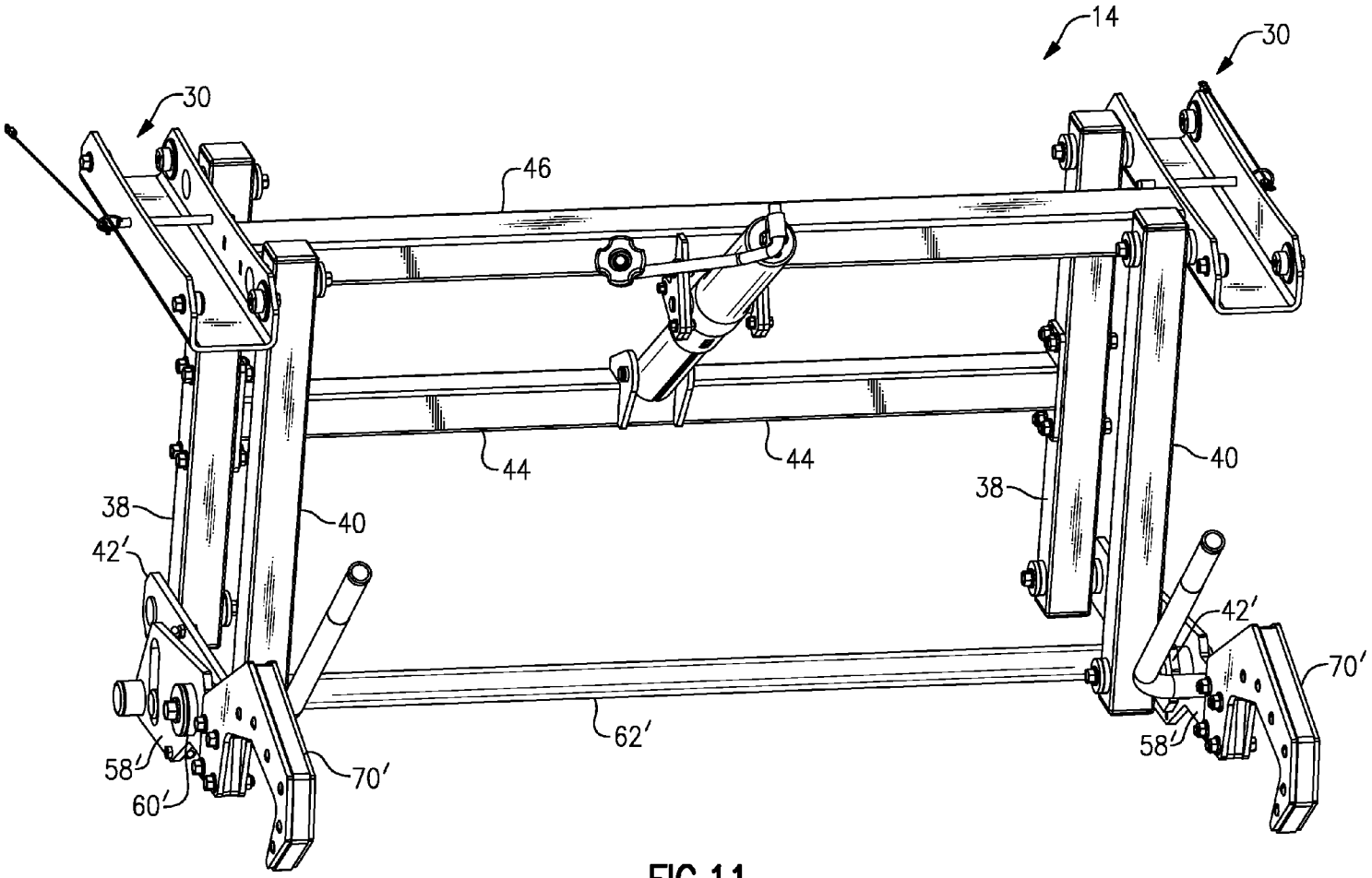
FIG. 11 is a bottom perspective view of the adjustable support of FIG. 8.
Figure 12:
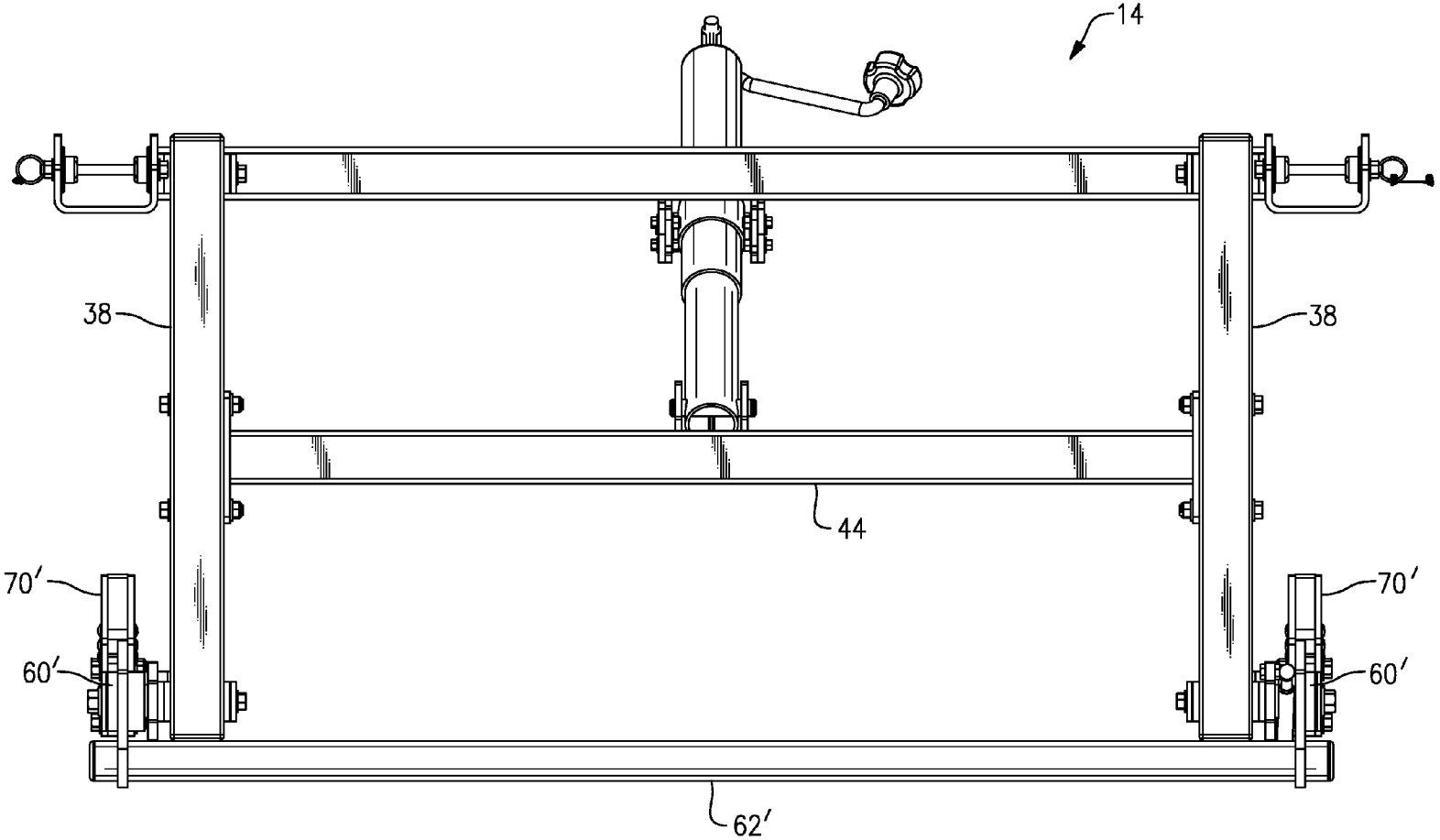
FIG. 12 is a top view of the adjustable support of FIG. 8.
Figure 13:
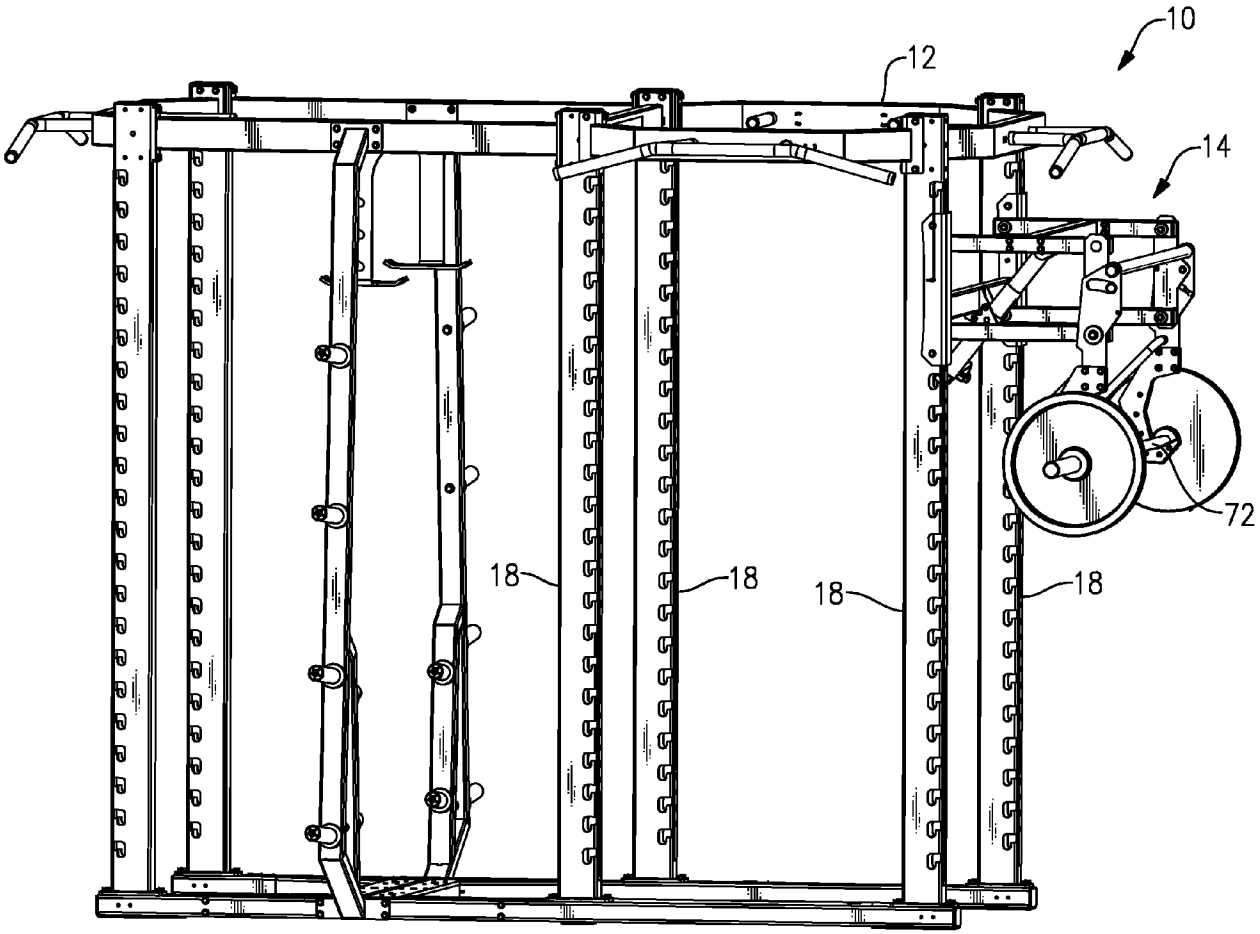
FIG. 13 is a perspective view of the example adjustable support of FIG. 8 attached to a front pair of upright frame members.

FIGS. 8-14 illustrate another example adjustable support 14' including another example pair of brackets 42', another example catch member 58', and another example catch member connecting arm 62'. A spring loaded member 60' is located adjacent the pivot axis of the catch members 58' and the lower pair of arms 40 for biasing the catch members 58' toward a retracted position where the stopper 68' engages a first end 66*a*' of the slot 66' (FIG. 9). The biasing force of the spring loaded members 60' is overcome when the weight bar 72 is placed on the hook portions 70' or when elongated handles 76' are biased outward so that the catch members 58' move to a generally vertical position where the stopper 68' engages a second end **66*b*' of the slot 66' (FIG. 9**).

The example adjustable support 14' can be moved to different vertical positions as desired for squats, bench presses, etc. as the adjustable support 14.

Although an example embodiment of this disclosure has been disclosed, a worker of ordinary skill in this art would recognize that certain modifications would come within the scope of this disclosure. For that reason, the following claims should be studied to determine the true scope and content of this invention.

What is claimed is:

1. An exercise device, comprising:

at least one attachment structure configured to be mounted to a support assembly;

a first arm pivotably connected to the at least one attachment structure;

a second arm pivotably connected to the at least one attachment structure;

at least one bracket pivotably connecting an end of the first arm with an end of the second arm; and at least one catch member pivotably connected to at least one of the first arm, the second arm, and the at least one bracket, wherein the at least one catch member is configured for accepting a weight bar, wherein the at least one of the at least one catch member and the at least one bracket includes a slot and the other of the at least one catch member and the at least one bracket includes a protrusion configured to be accepted within the slot to limit the motion of the at least one catch member relative to the at least one bracket.

2. The exercise device of claim 1, wherein the at least one attachment structure is parallel to the at least one bracket.

3. The exercise device of claim 2, wherein the first arm is parallel to the second arm.

4. The exercise device of claim 1, wherein the at least one catch member includes the slot and the at least one bracket includes the protrusion configured to be accepted within the slot to limit the motion of the at least one catch member relative to the at least one bracket.

5. The exercise device of claim 4, wherein the slot is arcuate.

6. The exercise device of claim 1, including an extension member configured to move the first arm relative to the at least one attachment structure.

7. The exercise device of claim 1, wherein a spring loaded member is located adjacent the pivot axis the at least one catch member to bias the at least one catch member towards a retracted position.

8. The exercise device of claim 1, wherein the at least one attachment structure includes protrusions configured to engage openings on the support assembly.

9. The exercise device of claim 1, wherein the at least one catch member includes a hook portion on an end.

10. The exercise device of claim 1, wherein the at least one attachment structure includes a first pivotable connection and a second pivotable connection, the first arm pivotably connected to the at least one attachment structure at the first pivotable connection and the second arm pivotably connected to the at least one attachment structure at the second pivotable connection.

11. The exercise device of claim 1, wherein the at least one catch member is pivotable relative to the at least one bracket.

12. An exercise assembly, comprising:

a support frame;

an exercise device attached to the support frame, wherein the exercise device comprises:

at least one attachment structure configured to be mounted to a support assembly;

a first arm pivotably connected to the at least one attachment structure;

a second arm pivotably connected to the at least one attachment structure, wherein the first arm is parallel to the second arm;

at least one bracket pivotably connecting an end of the first arm with an end of the second arm wherein the at least one attachment structure is parallel to the at least one bracket; and at least one of catch member pivotably connected to at least one of the first arm, the second arm, and the at least one bracket, wherein the at least one catch member is configured for accepting a weight bar.

13. The exercise assembly of claim 12, including an extension member configured to move the first arm relative to the at least one attachment structure.

14. The exercise assembly of claim 12, wherein the at least one catch member includes a slot and the at least one bracket includes a protrusion configured to be accepted within the slot to limit the motion of at least one catch member relative to the at least one bracket.

15. The exercise assembly of claim 12, wherein a spring loaded member is located adjacent the pivot axis of the at least one catch member to bias the at least one catch member towards a retracted position.

16. The exercise assembly of claim 12, wherein the at least one attachment structure includes a first pivotable connection and a second pivotable connection, the first arm pivotably connected to the at least one attachment structure at the first pivotable connection and the second arm pivotably connected to the at least one attachment structure at the second pivotable connection.

17. The exercise assembly of claim 12, wherein the at least one catch member is pivotable relative to the at least one bracket.

18. The exercise assembly of claim 12, wherein the at least one of the at least one catch member and the at least one bracket includes a slot and the other of the at least one catch member and the at least one bracket includes a protrusion configured to be accepted within the slot to limit the motion of the at least one catch member relative to the at least one bracket.

19. A method of adjusting a height of an exercise device comprising the steps of:

a) selecting a first course height of the exercise device by selecting a location along a structure support assembly to attach at least one attachment structure on the exercise device to the structure support assembly, wherein the exercise device includes:

a first arm pivotably connected to the at least one attachment structure;

a second arm pivotably connected to the at least one attachment structure;

at least one bracket pivotably connecting an end of the first arm with an end of the second arm; and at least one catch member configured to accept a weight bar and pivotable relative to the at least one first bracket;

b) selecting a second fine height of the exercise device by engaging an extension member; and c) maintaining a first arm parallel to a second arm during step b).

20. The method of claim 19, wherein the exercise device is removably attached to the attachment structure at a plurality of vertical locations along the attachment structure.

21. The method of claim 19, including biasing at least one catch member toward a retracted position.

22. The method of claim 19, including maintaining at least one bracket parallel to the at least one attachment structure during step b).

23. The method of claim 19, wherein selecting the first course height includes selecting larger height increments than selecting the second fine height.

* * * * *